US005108646A

United States Patent [19]

Beerse et al.

[11] Patent Number: 5,108,646

[45] Date of Patent: Apr. 28, 1992

[54] PROCESS FOR AGGLOMERATING ALUMINOSILICATE OR LAYERED SILICATE DETERGENT BUILDERS

[75] Inventors: Lisa A. Beerse, Maineville, Ohio; David R. Nassano, Cold Springs, Ky.; Eugene J. Pancheri, Montogomery; John A. Sagel, Cincinnati, both of Ohio

[73] Assignee: The Procter & Gamble Company, Cincinnati, Ohio

[21] Appl. No.: 604,721

[22] Filed: Oct. 26, 1990

[51] Int. Cl.[5] ..... C11D 17/00

[52] U.S. Cl. ..... 252/174.25; 252/135; 252/140; 252/174

[58] Field of Search ..... 252/135, 140, 174, 174.25

[56] References Cited

U.S. PATENT DOCUMENTS

| | | | |
|---|---|---|---|
| 4,096,081 | 6/1978 | Phenicie et al. | 252/135 |
| 4,414,130 | 11/1983 | Cheng | 252/140 |
| 4,528,276 | 7/1985 | Cambell et al. | 252/135 |
| 4,539,130 | 9/1985 | Thompson | 252/174 |
| 4,664,839 | 5/1987 | Rieck | 252/135 |

FOREIGN PATENT DOCUMENTS

| | | |
|---|---|---|
| 22024 | 1/1981 | European Pat. Off. . |
| 340013 | 11/1989 | European Pat. Off. . |
| 364881 | 4/1990 | European Pat. Off. . |
| 368137 | 5/1990 | European Pat. Off. . |

OTHER PUBLICATIONS

Chemical Engineers' Handbook 5th Edition Aug. 1980 by Robert Perry pp. 21-41.

*Primary Examiner*—A. Lionel Clingman
*Assistant Examiner*—William S. Parks
*Attorney, Agent, or Firm*—Donald E. Hasse; Thomas H. O'Flaherty; Jack D. Schaeffer

[57] ABSTRACT

A process for making detergent builder agglomerates by mixing crystalline aluminosilicate or layered silicate detergent builder with selected binder in an energy-intensive mixer to form free flowing agglomerates. The binder is an anionic synthetic surfactant paste or a water-soluble polymer containing at least about 50% by weight of ethylene oxide, and optionally may contain minor amounts of ethoxylated nonionic surfactant. The agglomerates are also substantially free of amorphous alkali metal silicates if free water is present.

10 Claims, No Drawings

PROCESS FOR AGGLOMERATING ALUMINOSILICATE OR LAYERED SILICATE DETERGENT BUILDERS

TECHNICAL FIELD

This invention relates to a process for agglomerating crystalline aluminosilicate and/or layered silicate detergent builders by mixing such materials with selected binders in an energy intensive mixer, such as an Eirich mixer. The process results in free flowing agglomerates having good dispersibility in water. The agglomerates are useful as detergent additives, particularly in granular laundry detergent compositions.

BACKGROUND OF THE INVENTION

Admixing aluminosilicate builders with other ingredients commonly used in detergent compositions offers several advantages over spray drying crutcher mixes containing aluminosilicates. First of all, higher product densities and reduced drying loads can be achieved by removing aluminosilicates from the crutcher and admixing them. Aluminosilicates also interact with carbonates and amorphous silicates typically present in the crutcher, resulting in poorer calcium ion exchange capacity and granules solubility, respectively.

Agglomerates or particles containing aluminosilicate builders are described in the art. For example, U.S. Pat. No. 4,528,276, Cambell et al, issued Jul. 9, 1985, discloses agglomerates formed by mixing hydrated alkali metal silicates with zeolites while adding heat and moisture.

U.S. Pat. No. 4,096,081, Phenicie et al, issued Jun. 20, 1978, discloses detergents containing particulate mixtures of aluminosilicate, salt, and agglomerating agent, including polymers containing ethylene oxide units. The particulates are preferably made by spray drying or spray cooling. The agglomerating agent represents about 0.3 to about 3 parts of the particulate composition.

U.S. Pat. No. 4,414,130, Cheng, issued Nov. 8, 1983, discloses zeolite (preferably amorphous) agglomerates made using a water-soluble binder. Example 8 discloses an agglomerate made by mixing 50 parts amorphous zeolite and 50 parts linear alkylbenzene sulfonate slurry (60% active). It is noted that when crystalline Zeolite A is used in place of amorphous zeolite, the products are "pasty and never become satisfactorily flowing".

European Patent Application 340,013, published Nov. 2, 1989, discloses granular detergents containing 17–35% surfactant, at least part of which is anionic, and 28–45% (anhydrous basis) zeolite. The composition is prepared by granulation and densification in a high speed mixer/granulator in the presence of a binder, preferably water. In Examples 11–12, a powder prepared by dry mixing linear alkylbenzene sulfonate, nonionic surfactant zeolite, and other ingredients is densified/granulated after adding on 1% water as a binder.

European Patent Application 364,881, published Apr. 25, 1990, discloses in Example 7 "free-flowing granulates" made by granulating 12% nonionic surfactant, 20% of a suspension (31% active) of alpha-sulfo-fatty acid methyl ester surfactant, and 68% zeolite.

European Patent Application 22,024, published Jan. 7, 1981, discloses agglomerates containing zeolite, linear alkylbenzene sulfonate and polyethylene glycol. The only example shows drying a suspension of these ingredients to produce particles, not agglomerates.

U.S. Pat. No. 4,664,839, Rieck, issued May 12, 1987, discloses crystalline layered silicate builders and detergent compositions containing them.

Despite disclosures in the art of aluminosilicate agglomerates, there is a continuing need for development of a process for making free flowing agglomerates containing aluminosilicate and/or layered silicate builders having good dispersibility in water.

SUMMARY OF THE INVENTION

The present invention relates to a process for making detergent builder agglomerates, said process comprising mixing:

(a) from about 50 parts to about 75 parts of crystalline detergent builder selected from the group consisting of:

(i) aluminosilicate ion exchange material of the formula $Na_z[(AlO_2)_z.(SiO_2)_y].xH_2O$, wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(ii) a layered silicate material of the formula $NaMSi_xO_{2x+1}.yH_2O$, wherein M is sodium or hydrogen, x is a number from 1.9 to 4, and y is a number from 0 to 20, said material having a particle size of from about 0.1 micron to about 10 microns; and (iii) mixtures thereof; and (b) from about 20 parts to about 35 parts of binder consisting essentially of:

(1) an anionic synthetic surfactant paste having a viscosity of at least about 1500 cps, or mixtures thereof with ethoxylated nonionic surfactants where the weight ratio of said anionic surfactant paste to ethoxylated nonionic surfactant is at least about 3:1; or (2) a water-soluble polymer containing at least about 50% by weight of ethylene oxide and having a viscosity of from about 325 cps to about 20,000 cps, or mixtures thereof with ethoxylated nonionic surfactant where the weight ratio of said polymer to ethoxylated nonionic surfactant is at least about 1:1;

wherein the weight ratio of crystalline detergent builder to binder is from about 1.75:1 to about 3.5:1, and said mixture is substantially free of amorphous alkali metal silicates when it contains free water;

in an energy intensive mixer imparting from about $1\times10^{11}$ to about $2\times10^{12}$ erg/kg of energy to said mixture at a rate of from about $1\times10^{9}$ to about $3\times10^{9}$ erg/kg.s to form free flowing agglomerates having a mean particle size of from about 200 to about 800 microns.

DETAILED DESCRIPTION OF THE INVENTION

The present invention relates to a process for agglomerating crystalline aluminosilicate and/or layered silicate detergent builders by mixing such materials with selected binders in an energy intensive mixer. The resulting agglomerates are free flowing and have good dispersibility. The agglomerates can also be made in high yield (i.e., having the desired average particle size and size distribution).

CRYSTALLINE DETERGENT BUILDER

The agglomerates of the present invention are made by mixing from about 50 parts to about 75 parts, preferably from about 60 to about 75 parts, more preferably from about 65 to about 75 parts, by weight of crystalline detergent builder material selected from the group consisting of aluminosilicate ion exchange material, layered silicate material, and mixtures thereof, with a suitable binder.

Crystalline aluminosilicate ion exchange material useful herein are of the formula $$Na_z[(AlO_2)_z.(SiO_2)_y].xH_2O$$

wherein z and y are at least about 6, the molar ratio of z to y is from about 1.0 to about 0.5 and x is from about 10 to about 264.

The aluminosilicate ion exchange builder materials herein are in hydrated form and contain from about 10% to about 28% of water by weight. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq/g. to about 352 mg. eq/g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

Aluminosilicate ion exchange materials useful in the practice of this invention are commercially available. The aluminosilicates can be naturally-occurring or synthetically derived. A method for producing aluminosilicate ion exchange materials is discussed in U.S. Pat. No. 3,985,669, Krummel, et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27.

The crystalline layered sodium silicates herein have the composition $NaMSi_xO_{2x+1}.yH_2O$, in which M denotes sodium or hydrogen, x is 1.9 to 4 and y is 0 to 20. These materials are described in U.S. Pat. No. 4,664,839, Rieck, issued May 12, 1987, incorporated herein by reference. In the above formula, M preferably represents sodium. Preferred values of x are 2, 3 or 4. Compounds having the composition $NaMSi_2O_5.yH_2O$ are particularly preferred.

The crystalline layered silicates preferably have an average particle size of from about 0.1 micron to about 10 microns. Examples of preferred layered silicates include Na-SKS-6 and Na-SKS-7, both commercially available from Hoechst.

Binder

The agglomerates of the present invention are made by mixing the above crystalline builder with from about 20 parts to about 35 parts, preferably from about 25 parts to about 35 parts, more preferably from about 25 parts to about 32 parts, by weight of a selected binder material. The binder must be in a fluid state during mixing to form agglomerates. If it is a solid at ambient temperature, it must be heated to a molten state for agglomeration to occur.

Suitable binders include any anionic synthetic surfactant paste having a viscosity of at least about 1500 cps, and preferably from about 1500 to about 17,000 cps. As used herein, viscosity is measured by using a Brookfield RV Viscometer, with measurements taken at the following conditions:

Temperature: 70° F. (21.1° C.) for materials not solid or gelatinous at room temperature.
140°-160° F. (60°-71.1° C.) for materials solid or gelatinous at room temperature.

Spindle Number:
Spindle #1 for viscosity <100 cps
Spindle #2 for viscosity 100-700 cps
Spindle #3 for viscosity 800-3000 cps
Spindle #4 for viscosity 3000-7000 cps
Spindle #5 for viscosity 7000-10,000 cps
Spindle #6 for viscosity >10,000 cps Spindle Speed: 20 rpm.

The anionic surfactants herein are used in the form of pastes or concentrated mixtures with water. These anionic pastes contain from about 0% to about 90% water, preferably from about 2% to about 75% water, and most preferably from about 4% to about 60% water (all by weight).

While not intending to be limited by theory, it is believed that such high viscosity binders are dispersed more evenly on the surfaces of the crystalline builders herein in the energy intensive mixer. The crystalline builders absorb water in the anionic surfactant paste leaving a wax-like binder that easily forms larger particles of the desired size in the mixer. The wax-like binder system is believed not to be strong enough to maintain particle sizes larger than described herein. This prevents overagglomeration and results in homogeneous particles having a narrow size distribution.

Useful anionic surfactants include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups). Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Patent Nos. 2,220,099, and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium potassium salts of alkyl. ethylene oxide ether sulfates containing about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Other anionic surfactants useful in the present invention include alkyl ethoxy carboxylate surfactants of the formula $$RO(CH_2CH_2O)_xCH_2COO^-M^+$$

wherein R is a $C_8$ to $C_{18}$ alkyl group, x is a number averaging from about 1 to 15, and M is an alkali metal or an alkaline earth metal cation. The alkyl chain having from about 8 to about 18 carbon atoms can be derived from fatty alcohols, olefins, etc. The alkyl chain is desirably a straight saturated alkyl chain, but it can also be a branched and/or unsaturated alkyl chain.

Preferred anionic surfactants are selected from the group consisting of $C_{11}$–$C_{13}$ linear alkylbenzene sulfonates, $C_{10}$–$C_{18}$ alkyl sulfates, and $C_{10}$–$C_{18}$ alkyl sulfates ethoxylated with an average of from about 1 to about 6 moles of ethylene oxide per mole of alkyl sulfate, and mixtures thereof.

The anionic surfactant paste can also contain minor amounts of ethoxylated nonionic surfactant. In such cases, the weight ratio of anionic surfactant to ethoxylated nonionic surfactant should be at least about 3:1, preferably at least about 4:1, more preferably at least about 5:1. Such nonionic surfactants include compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15, preferably about 8 to 13, carbon atoms, in either a straight chain or branched chain configuration, with from about 3 to 20, preferably from about 4 to about 14, more preferably from about 4 to about 8, moles of ethylene oxide per mole of alkyl phenol.

Preferred nonionic surfactants are the water-soluble and water-dispersible condensation products of aliphatic alcohols or carboxylic acids containing from 8 to 22 carbon atoms, in either straight chain or branched configuration, with from 3 to 60 preferaby from about 3 to about 20, moles of ethylene oxide per mole of alcohol or acid. Particularly preferred are the condensation products of alcohols having an alkyl group containing from about 9 to 16 carbon atoms with from about 4 to 14, preferably from about 4 to 8, moles of ethylene oxide per mole of alcohol.

The binder of the present invention can also be any water-soluble polymer containing at least about 50% by weight of ethylene oxide and having a viscosity of from about 325 cps to about 20,000 cps, preferably from about 375 to about 17,000 cps.

Such polymers (or mixtures thereof) generally should have a melting point not less than about 35° C. Preferably the polymeric material will have a melting point not less than about 45° C., more preferably not less than about 50° C. and most preferably not less than about 55° C. Because the polymeric materials useful in the practice of the invention are generally mixtures representing a range of molecular weights, the materials tend to soften and begin to become liquid over a range of temperatures of from about 3° C. to about 7° C. above their complete melting point. Mixtures of two or more polymeric materials can have an even wider range.

Preferred polymers contain at least about 70% ethylene oxide by weight and more preferred polymers contain at least about 80% ethylene oxide by weight. Preferred polymeric materials have HLB values of at least about 15, and more preferably at least about 17. Polyethylene glycol which can be said to contain essentially 100% ethylene oxide by weight is particularly preferred.

Preferred polyethylene glycols have an average molecular weight at least about 1000, and more preferably from about 2500 to about 20,000 and most preferably from about 3000 to about 10,000.

Other suitable polymeric materials are the condensation products of $C_{10}$–$C_{20}$ alcohols or $C_8$–$C_{18}$ alkyl phenols with sufficient ethylene oxide, not less than 50% by weight of the polymer, that the resultant product has a melting point not below about 35° C.

Block and heteric polymers based on ethylene oxide and propylene oxide addition to a low molecular weight organic compound containing one or more active hydrogen atoms are suitable in the practice of the invention. Polymers based on the addition of ethylene oxide and propylene oxide to propylene glycol, ethylenediamine, and trimethylopropane are commercially available under the names Pluronics®, Pluronics® F, Tetronics® and Pluradots® from the BASF Wyandotte Corporation of Wyandotte, Mich.

Polymer binders herein can also contain the ethoxylated nonionic surfactants described above, provided the weight ratio of polymer to ethoxylated nonionic surfactant is at least about 1:1. Preferably, this ratio is at least about 2:1, more preferably at least about 3:1. Such mixtures of polymer binder and nonionic surfactant can also contain water without adversely affecting the agglomerates. However, polymer binders herein without the ethoxylated nonionic surfactant should be substantially free of water to avoid an undesired viscosity reduction.

A particularly preferred binder system herein contains a mixture of polyethylene glycol having an average molecular weight of from about 3000 to about 10,000 with an ethoxylated nonionic surfactant which is a condensation product of a $C_9$–$C_{16}$ alcohol with from about 4 to 8 moles of ethylene oxide per mole of alcohol. Such mixtures result in better cleaning performance than when other binder systems are used. While not wishing to be bound by theory, it is believed that polyethylene glycol/nonionic surfactant binder systems are stripped off of the crystalline builder material herein more quickly than other binders. This allows the builder material to begin working faster in the laundering solution, lowering the effective water hardness faster and leading to better cleaning performance.

In addition to the above, the levels of crystalline detergent builder to binder should be selected so that the weight ratio of such builder to binder is from about 1.75:1 to about 3.5:1, preferably from about 1.9:1 to about 3:1.

Moreover, to minimize interactions between the crystalline builder herein and amorphous alkali metal silicates which can compromise product solubility, the agglomerates of the present invention should be substantially free of amorphous alkali metal silicates commonly used in granular detergents (i.e., those having a molar ratio of $SiO_2$ to alkali metal oxide of from about 1.0 to about 3.2) when they contain free water. Preferably, the agglomerates contain less than about 1% by weight of such silicates, and more preferably they are completely free of such silicates, when they contain free water.

The agglomerates of the present invention can also contain minor amount (e.g., up to about 30% by weight) of other ingredients which do not materially decrease performance and physical properties. For example, the agglomerates can contain inorganic salts such as disclosed in the above mentioned U.S. Pat. No. 4,096,081, Phenicie et al, particularly from Column 14, line 53 to Column 15, line 8, incorporated herein by reference. Such salts appear to reduce the level of binder required to make good agglomerates according to the present invention. Hydrotropes such as toluene, xylene, and cumene sulfonates can also be used to provide similar effects.

The agglomerates can also contain other surfactants or ingredients, including ingredients which are heat sensitive or otherwise degraded by materials in a crutcher mix slurry that is spray dried to form the balance of a finished detergent composition. For example, the agglomerates can contain alkylpolysaccharide surfactants such as disclosed in U.S. Pat. No. 4,536,317, Llenado et al, issued August 20, 1985, incorporated herein by reference.

The agglomerates can also contain polyhydroxy fatty acid amide surfactants of the structural formula:

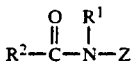

$$R^2-\overset{\overset{\displaystyle O}{\|}}{C}-\overset{\overset{\displaystyle R^1}{|}}{N}-Z \qquad (I)$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $-CH_2-(CHOH)_n-CH_2OH$, $-CH(CH_2OH)-(CHOH)_{n-1}-CH_2OH$, $-CH_2-(CHOH)_2(CHOR')(CHOH)-CH_2OH$, and alkoxylated derivatives thereof, where n is an integer from 3 to 5, inclusive, and R' is H or a cyclic or aliphatic monosaccharide. Most preferred are glycityls wherein n is 4, particularly $-CH_2-(CHOH)_4-CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2-CO-N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, N-1-deoxygalactityl, N-1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E.R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In a preferred process for producing N-alkyl or N-hydroxyalkyl, N-deoxyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxypropyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole % to about 10 mole %, on an N-alkyl or N-hydroxyalkyl-glucamine molar basis. The reaction is preferably carried out at from about 138° C. to about 170° C. for typically from about 20 to about 90 minutes. When glycerides are utilized in the reaction mixture as the fatty ester source, the reaction is also preferably carried out using from about 1 to about 10 weight % of a phase transfer agent, calculated on a weight percentage basis of the total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This also seeds the reaction, thereby increasing reaction rate. A detailed experimental procedure is provided below in Example I.

The polyhydroxy "fatty acid" amide materials used herein also offer the advantages to the detergent formulator that they can be prepared wholly or primarily from natural, renewable, non-petrochemical feedstocks and are degradable. They also exhibit low toxicity to aquatic life.

It should be recognized that along with the polyhydroxy fatty acid amides of Formula (I), the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amide-containing composition added to the detergent contains less than about 10%, preferably less than about 4%, of cyclic polyhydroxy fatty acid amide. The preferred processes described above are advantageous in that they can yield rather low levels of by-products, including such cyclic amide by-product.

Energy Intensive Mixer

The agglomerates of the present invention are made by mixing the above crystalline builder and binder materials, at the specified levels, in an energy intensive mixer imparting from about $1\times10^{11}$ to about $2\times10^{12}$ erg/kg of energy to said mixture at a rate of from about $1\times10^{9}$ to about $3\times10^{9}$ erg/kg.s to form free flowing agglomerates having a mean particle size of from about 200 to about 800 microns, preferably from about 300 to about 600 microns. The actual size of the agglomerates preferably is selected to match to size of detergent particles mixed with the agglomerates to minimize product segregation. The energy input and rate of input can be determined by calculations from power readings to the mixer with and without product, residence time of product in the mixer, and mass of product in the mixer.

The total energy imparted to the mixture of crystalline builder and binder is preferably from about $2\times10^{11}$ to about $1.5>10^{12}$ erg/kg, more preferably from about $2.5\times10^{11}$ to about $1.3\times10^{12}$ erg/kg.

The rate of energy input to the mixture is preferably from about $1.2\times10^{9}$ to about $2.5\times10^{9}$ erg/kg.sec, more preferably from about $1.4\times10^{9}$ to about $2.2\times10^{9}$ erg/kg.sec.

Higher energy levels and/or rates of energy input than described herein tend to overagglomerate the mixture and result in formation of a doughy mass. Lower energy levels and/or rates of energy input tend to result in fine powders and light, fluffy agglomerates having poor physical properties and/or undesirably broad particle size distribution.

The preferred energy intensive mixer used herein is an Eirich Type R Intensive Mixer, although other mixers known in the art such as Littleford, and Lodige KM can be used. However, Schugi, O'Brien, and pug mill mixers do not provide the required energy input and/or rate and are not suitable for use in the present invention.

Detergent Compositions

The agglomerates of the present invention can be used as is as a detergent builder or additive composition. Preferably, the agglomerates are incorporated in a fully formulated, granular laundry detergent composition. In such a composition, the agglomerates herein represent from about 5% to about 75%, preferably from about 10% to about 60%, more preferably from about 15% to about 50%, by weight of the composition. The balance of the composition can be other surfactants, builders, and ingredients commonly found in such compositions. The agglomerates herein are generally admixed with the other detergent ingredients, some of which can be spray dried such as disclosed in U.S. Pat. No. 4,963,226, Chamberlain, issued October 16, 1990, incorporated herein by reference. Materials that are heat sensitive or degraded by other materials in a crutcher mix slurry are generally admixed into the finished granular detergent composition.

Anionic, nonionic, zwitterionic, ampholytic, and cationic surfactants useful in fully formulated detergent compositions are disclosed in U.S. Pat. No. 3,919,678, Laughlin et al, issued Dec. 30, 1975, incorporated herein by reference. Preferred surfactants include the anionic and ethoxylated nonionic surfactants described above as part of the agglomerate. The anionic surfactants are particularly preferred.

The granular detergent compositions herein generally comprise from about 5% to about 80%, preferably from about 10% to about 60%, more preferably from about 15% to about 50%, by weight of detergent surfactant.

Nonlimiting examples of suitable water-soluble, inorganic detergent builders useful herein include: alkali metal carbonates, borates, phosphates, bicarbonates and silicates. Specific examples of such salts include sodium and potassium tetraborates, bicarbonates, carbonates, orthophosphates, pyrophosphates, tripolyphosphates and metaphosphates.

Examples of suitable organic alkaline detergency builders include: (1) water-soluble amino carboxylates and aminopolyacetates, for example, nitrilotriacetates, glycinates, ethylenediaminetetraacetates, N-(2-hydroxyethyl)nitrilo diacetates and diethylenetriamine pentaacetates; (2) water-soluble salts of phytic acid, for example, sodium and potassium phytates; (3) water-soluble polyphosphonates, including sodium, potassium, and lithium salts of ethane-1-hydroxy-1, 1-diphosphonic acid; sodium, potassium, and lithium salts of ethylene diphosphonic acid; and the like; (4) water-soluble polycarboxylates such as the salts of lactic acid, succinic acid, malonic acid, maleic acid, citric acid, oxydisuccinic acid, carboxymethyloxysuccinic acid, 2-oxa-1,1,3-propane tricarboxylic acid, 1,1,2,2-ethane tetracarboxylic acid, mellitic acid and pyromellitic acid; (5) water-soluble polyacetals as disclosed in U.S. Pat. Nos. 4,144,266 and 4,246,495 incorporated herein by reference; and (6) the water-soluble tartrate monosuccinates and disuccinates, and mixtures thereof, disclosed in U.S. Pat. No. 4,663,071 Bush et al, issued May 5, 1987, incorporated herein by reference.

Another type of detergency builder material useful in the final granular detergent product comprises a water-soluble material capable of forming a water-insoluble reaction product with water hardness cations preferably in combination with a crystallization seed which is capable of providing growth sites for said reaction product. Such "seeded builder" compositions are fully disclosed in British Patent No. 1,424,406.

Aluminosilicate detergent builders, both crystalline and amorphous, such as disclosed in U.S. Pat. No. 4,605,509, Corkill et al, issued Aug. 12, 1986, can also be included in the granular detergents of the present invention.

The detergency builder generally comprises from about 10% to 90%, preferably from about 15% to 75%, more preferably from about 20% to 60%, by weight of the spray-dried detergent composition.

Optional components which can be included in the granular detergents herein are materials such as softening agents, enzymes (e.g., proteases and amylases), bleaches and bleach activators, other soil release agents, soil suspending agents, fabric brighteners, enzyme stabilizing agents, color speckles, suds boosters or suds suppressors, anticorrosion agents, dyes, fillers, germicides, pH adjusting agents, nonbuilder alkalinity sources, and the like.

All percentages, parts and ratios herein are by weight unless otherwise specified.

The following examples illustrate the compositions and processes of the present invention.

In the examples, Zeolite A refers to hydrated crystalline Zeolite A containing about 20% water and having an average particle size of 1 to 10 microns; LAS refers to sodium $C_{12.3}$ linear alkylbenzene sulfonate; AS refers to sodium $C_{14}$–$C_{15}$ alkyl sulfate; $AE_3S$ refers to sodium coconutalkyl polyethoxylate (3) sulfate and $CnAE_{6.5}T$ refers to coconut alcohol condensed with about 6.5 moles of ethylene oxide per mole of alcohol and stripped of unethoxylated and monoethoxylated alcohol.

EXAMPLES I-II

| | I | I | II |
|---|---|---|---|
| | Parts By Weight | | |
| | Before Drying | After Drying | Before Drying |
| Zeolite A | 72.00 | 81.52 | 72.00 |
| LAS | 13.44 | 15.22 | 12.10 |
| Sodium sulfate | 0.56 | 0.64 | 0.50 |
| Free water | 14.00 | 2.62 | 12.60 |
| $CnAE_{6.5}T$ | 0.00 | 0.00 | 2.80 |
| Total | 100.00 | 100.00 | 100.00 |

Agglomerates having the composition of Example I are made by mixing Zeolite A with anionic surfactant paste, containing 48% LAS surfactant, 2% sodium sulfate, and 50% water and having a viscosity of 5070 cps, in an Eirich R08 energy intensive mixer in a continuous mode. A heel is first made in the Eirich by weighing approximately 34.1 kg of powdered Zeolite A into the pan of the mixer, starting-up the mixer and then pumping approximately 13.2 kg of the surfactant paste into the mixer. Approximately 30 seconds of residence time is allowed for agglomeration. After production of the heel, zeolite feed is started, followed by surfactant paste feed. The feed rates and discharge rates are set to provide about 4 minutes residence time in the mixer. Product discharged from the mixer is then dried in a fluid bed at 240°-270° F. (116°-132° C.). The drying step removes most of the free water and changes the composition as described above. The total energy input by the mixer to the product on a continuous basis is approximately $1.31\times10^{12}$ erg/kg at a rate of approximately $2.18\times10^{9}$ erg/kg.s.

Agglomerates having the composition of Example II are made by mixing the Zeolite A and anionic surfactant paste from Example I with the $CnAE_{6.5}T$ nonionic surfactant in a batch making process using an Eirich RV02 energy intensive mixer. Batches are produced by weighing approximately 2.27 kg of powdered Zeolite A into the pan of the mixer. Approximately 1.0 kg of a premixed binder system containing the anionic surfactant paste and nonionic surfactant are introduced into the mixer through a funnel and directed into the rotor area within one minute. Total batch time is typically 3 minutes, but times up to about 10 minutes produce acceptable agglomerates. The rotor blade rotates in a counter-clockwise direction at about 3200 rpm, while the pan is rotated in a clockwise direction at 58 rpm (as measured with a tachometer). The total energy input by the mixer to the product is about $3.9\times10^{11}$ erg/kg at a rate of approximately $2.18\times10^{9}$ erg/kg·s.

Examples I and II produce free flowing agglomerates having a mean particle size of about 450–500 microns.

EXAMPLES III-VI

In the following examples, the BASE GRANULES are produced by spray drying an aqueous crutcher mix of the listed ingredients. The AGGLOMERATES are produced by mixing the listed ingredients in an energy intensive mixer until they yield uniform agglomerates according to the method of Example I. The resulting free-flowing agglomerates, which have a mean particle size of about 450–500 microns, are then admixed with the base granules in a mix drum, along with the ingredients listed under the ADMIX section.

| | III | IV | V | VI |
|---|---|---|---|---|
| | Parts by Weight | | | |
| BASE GRANULES | | | | |
| 70% LAS/30% AS | 17.98 | 17.98 | 15.31 | 19.65 |
| Zeolite A | 13.37 | 13.37 | 0.00 | 21.74 |
| Sodium polyacrylate (4500 MW) | 3.78 | 3.78 | 3.78 | 3.78 |
| Sodium Silicate (1.6 ratio) | 2.00 | 2.00 | 2.00 | 2.00 |
| Brightener | 0.30 | 0.30 | 0.30 | 0.30 |
| PEG 8000 | 1.74 | 1.74 | 1.74 | 1.74 |
| Sodium carbonate | 20.40 | 20.40 | 15.94 | 22.85 |
| Sodium sulfate | 10.40 | 10.40 | 10.40 | 10.40 |
| Moisture | 5.44 | 5.44 | 5.44 | 5.44 |
| Antifoam | 0.10 | 0.10 | 0.10 | 0.10 |
| Base gran. total | 75.51 | 75.51 | 55.01 | 89.00 |
| AGGLOMERATES | | | | |
| Zeolite A | 13.37 | 13.37 | 26.74 | 5.00 |
| LAS | 2.67 | 2.68 | 5.36 | 1.00 |
| Sodium Sulfate | 0.11 | 0.11 | 0.22 | 0.38 |
| Water | 3.35 | 2.68 | 5.36 | 0.63 |
| Cn AE6.5T | 0.00 | 0.66 | 2.32 | 0.00 |
| ADMIX | | | | |
| Citric acid | 3.00 | 3.00 | 3.00 | 3.00 |
| Enzyme | 1.09 | 1.09 | 1.09 | 1.09 |
| Cn AE6.5T | 0.50 | 0.50 | 0.50 | 0.50 |
| Perfume | 0.40 | 0.40 | 0.40 | 0.40 |
| Total | 100.00 | 100.00 | 100.00 | 100.00 |

EXAMPLES VII-X

In the following examples, the BASE GRANULES are produced by spray drying an aqueous crutcher mix of the listed ingredients. The AGGLOMERATES are produced by mixing the listed ingredients in an energy intensive mixer until they yield uniform agglomerates according to the method of Example I, except that the viscosity of the binder in Example VIII is about 400 cps and the viscosity of the binder in Example IX is somewhat higher. The resulting free-flowing agglomerates, which have a mean particle size of about 450–500 microns, are then admixed with the base granules in a mix drum, along with the ingredients listed under the ADMIX section.

| | VII | VIII | IX | X |
|---|---|---|---|---|
| | Parts by Weight | | | |
| BASE GRANULES | | | | |
| LAS | 17.98 | — | 8.99 | 12.59 |
| $AE_3S$ | — | 17.98 | 8.99 | — |
| AS | — | — | — | 5.39 |
| Zeolite A | 8.37 | 13.37 | 13.37 | 13.37 |
| Sodium polyacrylate (4500 MW) | 3.78 | 3.78 | 3.78 | 3.78 |
| Sodium oxydisuccinate | 5.00 | | | |
| Sodium Silicate (1.6 ratio) | 2.00 | 2.00 | 2.00 | 2.00 |
| Brightener | 0.30 | 0.30 | 0.30 | 0.30 |
| PEG 8000 | 1.74 | 1.74 | 1.74 | 1.74 |
| Sodium carbonate | 20.40 | 19.40 | 20.40 | 20.40 |
| Sodium sulfate | 10.40 | 10.40 | 10.40 | 10.40 |
| Moisture | 5.44 | 5.44 | 5.44 | 5.44 |
| Antifoam | 0.10 | 0.10 | 0.10 | 0.10 |
| Base gran. total | 75.51 | 74.51 | 75.51 | 75.51 |
| AGGLOMERATES | | | | |
| Zeolite A | — | 13.37 | 13.37 | 12.70 |
| Na-SKS-6 layered silicte | 13.37 | — | — | — |
| LAS | 2.67 | — | — | 2.54 |
| PEG-8000 | — | 3.56 | 2.50 | — |
| Sodium Sulfate | 0.11 | — | — | 0.10 |
| Water | 3.35 | — | 1.13 | 3.13 |
| Cn AE6.5T | 0.00 | 3.56 | 2.50 | 0.00 |
| ADMIX | | | | |
| Citric acid | 3.00 | 3.00 | 3.00 | 3.00 |
| Enzyme | 1.09 | 1.09 | 1.09 | 1.09 |
| Cn AE6.5T | 0.50 | 0.50 | 0.50 | 0.50 |
| Soil release polymer | — | — | — | 1.00 |
| Perfume | 0.40 | 0.40 | 0.40 | 0.40 |
| Total | 100.00 | 100.00 | 100.00 | 100.00 |

What is claimed is:

1. A process for making detergent builder agglomerates, said process comprising mixing:

(a) from about 50 parts to about 75 parts of crystalline detergent builder selected from the group consisting of:

(i) aluminosilicate ion exchange material of the formula $Na_z[(AlO_2)_z.(SiO_2)_y].xH_2O$, wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg $CaCO_3$ eq./g and a calcium ion exchange rate of at least about 2 grains $Ca^{++}$/gallon/minute/gram/gallon;

(ii) a layered silicate material of the formula $NaMSi_xO_{2x+1}.yH_2O$, wherein M is sodium or hydrogen, x is a number from 1.9 to 4, and y is a number from 0 to 20, said material having a particle size of from about 0:1 micron to about 10 microns; and (iii) mixtures thereof; and (b) from about 20 parts to about 35 parts of binder consisting essentially of:

(1) an anionic synthetic surfactant paste having a viscosity of at least about 1500 cps, or mixtures thereof with ethoxylated nonionic surfactants where the weight ratio of said anionic surfactant paste to ethoxylated nonionic surfactant is at least about 3:11 or (2) a water-soluble polymer containing at least about 50% by weight of ethylene oxide and having a viscosity of from about 325 cps to about 20,000 cps, or mixtures thereof with ethoxylated nonionic surfactant where the weight ratio of said polymer to ethoxylated nonionic surfactant is at least about 1:1;

wherein the weight ratio of crystalline detergent builder to binder is from about 1.75:1 to about 3.5:1, and said mixture is substantially free of amorphous alkali metal silicates when it contains free water;

in an energy intensive mixer imparting from about $1\times10^{11}$ to about $2\times10^{12}$ erg/kg of energy to said mixture at a rate of from about $1\times10^{9}$ to about $3\times10^{9}$ erg/kg.s to form free flowing agglomerates having a mean particle size of from about 200 to about 800 microns.

2. A process according to claim 1 wherein the crystalline detergent builder is an aluminosilicate material of the formula $$Na_{12}[(AlO_2)_{12}(SiO_2)_{12}].xH_2O$$

wherein x is from about 20 to about 30.

3. A process according to claim 1 wherein the crystalline detergent builder is a layered silicate material of the formula $NaMSi_2O_5.yH_2O$, wherein M is sodium N hydrogen and y is a number from 0 to 20.

4. A process according to claim 1 wherein the binder is an anionic synthetic surfactant paste comprising $C_{11}$–$C_{13}$ linear alkylbenzene sulfohates, $C_{10}$–$C_{18}$ alkyl sulfates, on $C_{10}$–$C_{18}$ alkyl sulfates ethoxylated with an average of from about 1 to about 6 moles of ethylene oxide per mole of alkyl sulfate.

5. A process according to claim 4 wherein the crystalline detergent builder is an aluminosilicate-material of the formula $$Na_{12}[(AlO_2)_{12}(SiO_2)_{12}].xH_2O$$

wherein x is from about 20 to about 30.

6. A process according to claim 1 wherein the binder is a polyethylene glycol having an average molecular weight of from about 3000 to about 10,000.

7. A process according to claim 6 wherein the binder further comprises an ethoxylated nonionic surfactant which is a condensation product of alcohols having an alkyl group containing from about 9 to 16 carbon atoms with from about 4 to 8 moles of ethylene oxide per mole of alcohol.

8. A process according to claim 7 wherein the crystalline detergent builder is an aluminosilicate material of the formula $$Na_{12}[(AlO_2)_{12}(SiO_2)_{12}].xH_2O$$

wherein x is from about 20 to about 30.

9. A process according to claim 1 comprising mixing from about 65 to about 75 parts of the crystalline detergent builder and from about 25 to about 35 parts of the binder in the energy intensive mixer.

10. A process according to claim 1 wherein the energy intensive mixer imparts from about $2.5\times10^{11}$ to about $1.3\times10^{12}$ erg/kg at a rate of from about $1.4\times10^{9}$ to about $2.2\times10^{9}$ erg/kg.sec.

* * * * *

UNITED STATES PATENT AND TRADEMARK OFFICE

CERTIFICATE OF CORRECTION

PATENT NO. : 5,108,646

DATED : April 28, 1992

INVENTOR(S) : LISA A. BEERSE ET AL

It is certified that error appears in the above-identified patent and that said Letters Patent is hereby corrected as shown below:

Column 14, line 40, Claim 1, "3:11" should be -- 3:1; --.

Column 14, line 67, Claim 3, "wherein M is sodium N hydrogen" should be -- wherein M is sodium or hydrogen --.

Column 15, line 3, Claim 4, "sulfohates" should be -- sulfonates --.

Column 15, line 4, Claim 4, "sulfates, on $C_{10}$-$C_{18}$" should be -- sulfates, or $C_{10}$-$C_{18}$ --.

Signed and Sealed this

Twenty-ninth Day of June, 1993

*Attest:*

Michael K. Kirk

MICHAEL K. KIRK

*Attesting Officer*

*Acting Commissioner of Patents and Trademarks*